United States Patent [19]

Hoshi

[11] 4,445,822

[45] May 1, 1984

[54] INJECTION PUMP

[75] Inventor: Yoshikazu Hoshi, Tokai, Japan

[73] Assignee: Hitachi, Ltd., Tokyo, Japan

[21] Appl. No.: 304,359

[22] Filed: Sep. 22, 1981

[30] Foreign Application Priority Data

Sep. 22, 1980 [JP] Japan ..... 55-130684

[51] Int. Cl.[3] ..... F04B 35/02; F04B 19/22; F02M 39/00

[52] U.S. Cl. ..... 417/388; 417/462; 123/450

[58] Field of Search ..... 417/462, 252, 253, 383, 417/390, 395, 388; 123/450

[56] References Cited

U.S. PATENT DOCUMENTS 3,107,661 10/1963 Kemp ..... 417/462
3,489,093 1/1970 Thornber ..... 417/307
3,851,635 12/1974 Murtin et al. ..... 123/458

FOREIGN PATENT DOCUMENTS 1210233 10/1970 United Kingdom ..... 417/462

*Primary Examiner*—William L. Freeh
*Assistant Examiner*—Paul F. Neils
*Attorney, Agent, or Firm*—Antonelli, Terry & Wands

[57] ABSTRACT

An injection pump includes a rotor having a central axial bore and a radial bore and rotated in relationship with an engine. A free piston reciprocably inserted in the central axial bore defines a first and second chamber. The first chamber includes a plurality of first radial passages and a radial spill port and communicate with the radial bore and the second pressure chamber includes a plurality of second radial passages and a discharge passage. A pair of plungers which is disposed in the radial bore is so constructed as to produce, in accordance with the revolution of the rotor, a compression period in which the liquid fuel is pressurized in the first pressure chamber and pressurized fuel in the second pressure chamber is supplied to the engine through the discharge passage, and a suction period in which the liquid fuel is supplied to the pressure chambers.

4 Claims, 5 Drawing Figures

INJECTION PUMP

BACKGROUND OF THE INVENTION

The present invention relates to an injection pump and, more particularly, to an fuel injection pump electro-mechanically controlling the fuel injection rate and injection timing.

The supply of fuel into an internal combustion engine at a high pressure has been made by a fuel injection pump. Recently, there is an increasing demand for an electronic control of the fuel injection pump, in which the rate and the timing of fuel injection are controlled. Such apparatus is disclosed in U.S. Pat. No. 4,185,779 issued on Jan. 29, 1980.

The conventional fuel injection pumps of the kind described incorporate servo mechanisms of various types and the controls for the fuel injection rate and timing are achieved by a feedback control of the servo mechanism.

In the fuel injection pumps in which the fuel injection rate is controlled, the fuel is charged by a solenoid valve into a high-pressure chamber in which the fuel is pressurized to a high pressure, and the amount of fuel injection per stroke of the plunger is determined by the timing of opening of the solenoid valve.

In the fuel injection pumps incorporating the servo mechanisms, the servo mechanisms are usually of the electric-hydraulic type servo mechanisms using the fuel itself as the medium. In fuel injection pumps of this type, the servo mechanism is too complicated and expensive, as is the electromechanical control circuit. In addition, the relationship between the mechanical position of the servo mechanism and the injection rate or timing, initially obtained after the assembling of the pump, is gradually changed as the mechanism is used a long time, due to wear or the like reason.

In the fuel injection pumps in which the injection rate is controlled through the control of opening timing of the solenoid valve, no consideration is made as to the control of the injection timing. If this type of injection pump is required to have a function for controlling also the fuel injection rate, it is necessary to combine this pump with the servo mechanism of the same type as that used in the first-mentioned type of fuel injection pump. Such a combination, however, is accompanied by the same problems as stated before.

SUMMARY OF THE INVENTION

An object of the invention is to provide a fuel injection pump which permits easy controls of both of the injection rate and timing, thereby to overcome the above-described problems of the prior art. The injection pump of the invention is suitable particularly for use as a fuel injection pump, but can be used as injection pumps handling other liquids than the fuel for an internal combustion engine.

According to the invention, the pressure chamber in which the pressurizing is effected in accordance with the revolution of the pump shaft is divided into two parts by a free piston. One of these two parts is supplied with the fuel concerned with the fuel injection rate, while the other part is supplied with the fuel concerned with the injection timing.

The amount of supply of fuel is determined by the timing of the opening and closing of the solenoid valve, so that the complicated feedback control circuit is eliminated.

Namely, according to the invention, there is provided an injection pump comprising: a first pressure chamber communicating with a first opening and closing means for sucking a liquid and with a pressurizing mechanism; a second pressure chamber communicating with a second opening and closing means for sucking the liquid and with a discharge passage through which the liquid is discharged; and a free piston disposed between the first pressure chamber and the second pressure chamber and capable of transmitting the pressure between the pressure chambers; the pressurizing mechanism being so constructed as to produce, in accordance with the revolution, a compression period for restraining pressurizing and compression and a suction period which permits the fuel to come in when at least one of the chambers is supplied with the fuel, alternatingly, whereby the timing of the discharge of the liquid and the amount of the liquid discharged are controlled through a control of the amount of the liquid sucked into the first and the second pressure chambers.

Preferably, the first pressure chamber is provided with a spill port adapted to be opened when the free piston has come to take a predetermined position; the spill port being adapted to permit the liquid in the first pressure chamber to be split to a low-pressure section thereby to finish the compression period.

Instead of the spill valve, it is possible to provide a high-pressure relief valve adapted to be opened when the pressure in the first pressurizing chamber has reached a predetermined high pressure.

According to a preferred form of the invention, the first and second pressurizing chambers are formed in a rotor adapted to be driven rotatively and the free piston is disposed between these chambers for a free axial movement, while the pressurizing mechanism is constituted by plungers slidably received by radial bores formed in the rotor and a cam ring stationarily arranged at the periphery of the plungers.

The invention will be described hereinunder through its preferred forms with specific reference to the accompanying drawings.

DESCRIPTION OF THE PREFERRED EMBODIMENT

Figure 1:
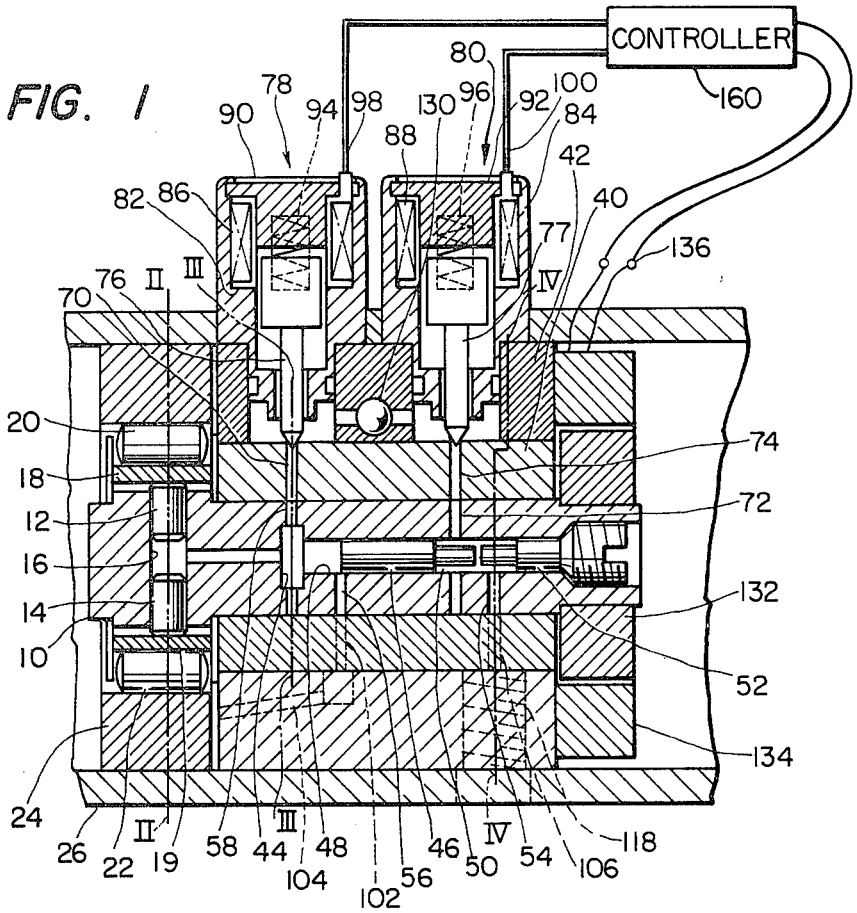
FIG. 1 is a vertical sectional view of an injection pump in accordance with a first embodiment of the invention.

Referring now to FIGS. 1 to 4, an injection pump of this invention has a rotor 10 adapted to be driven by a drive shaft (not shown) which rotates in synchronism with the engine. At one end of the rotor, are provided a pair of plungers 12, 14 slidably received by radial bore 16, roller shoes 18, 19 disposed at the outer sides of respective plungers 12, 4 and rollers 20, 22 associated with these shoes 18, 19. The plungers 12, 14 roller shoes 18, 19 and the rollers 20, 22 rotate as a unit with the rotor 10.

At the outer periphery of the roller 20, 22, is disposed a cam ring 24 that is secured to a housing 26 and provided on its inner peripheral surface with a convexed and concaved cam contour 28, 30, 32, 34, 36, 38. The rotor 10 is adapted to rotate on the inner peripheral surface of a sleeve 40 mounted in a sleeve holder 42 and fixed to the housing 26.

At the inside of the rotor 10, is formed a first pressure chamber 44, which is defined by two opposing plungers 12, 14 and the left end surface of a free piston 46 which is received by the central axial bore 48. A second pressure chamber 50 is defined by the right end surface of the free piston 46 and a stopper 52 which is fixed to the right end of the axial bore 48 to prevent leakage of the fuel.

The plungers 12, 14, roller shoes 18, 19, rollers 20, 22 and the cam ring 24, in combination, constitute a pressure mechanism which is in communication with the first pressure chamber 44. The second pressure chamber 50 is in communication with a discharge passage 54 formed in the radial direction of the rotor 10.

Figure 2:
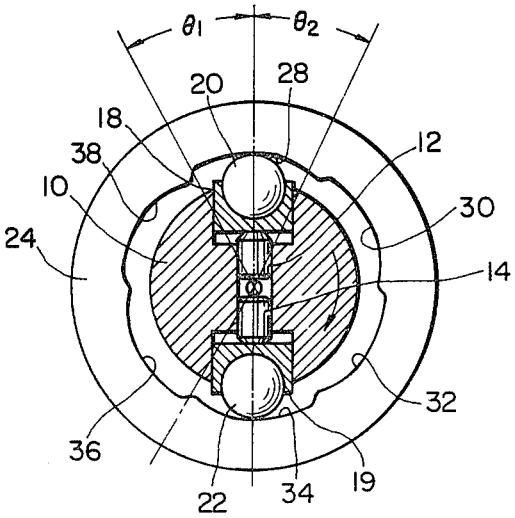
FIG. 2 is a sectional view taken along the line II—II of FIG. 1.
Figure 3:
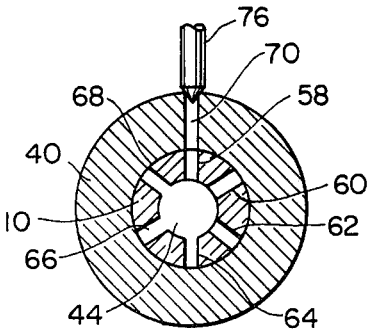
FIG. 3 is a sectional view taken along the line III—III of FIG. 1.
Figure 4:
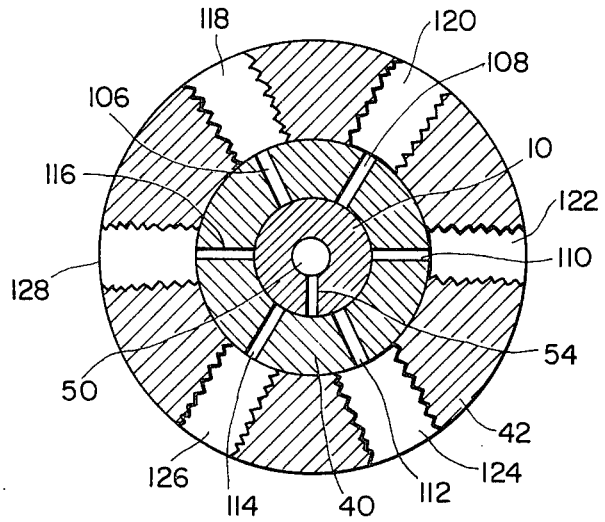
FIG. 4 is a sectional view taken along the line IV—IV of FIG. 1.

Referring to FIG. 2, the pressure mechanism is adapted to produce, in accordance with the rotation of the rotor 10 in which the mechanism is incorporated, a suction period $\theta_1$ for sucking the fuel and a compression period $\theta_2$ for compressing and discharging the fuel. The embodiment shown in FIG. 2 is a fuel injection pump for an internal combustion engine having 6 (six) cylinders. Thus, 6 (six) cam contours 28~38 are formed on the inner peripheral surface of the cam ring 24 at a constant circumferential pitch corresponding to the 6 cylinders. As will be described later, the suction period $\theta_1$ and the discharge period $\theta_2$ are determined in accordance with the configuration of the cam contour 28~38 of the cam ring 24 and the amount of liquid or fuel sucked into the first pressure chamber 44.

FIG. 1 shows the injection pump in the state after completion of compression period or in the state in the suction period. More specifically, the free piston 46 has been considerably displaced to the right so that the first chamber 44 is opened to a spill port 56 formed in the radial direction of the rotor 10.

Referring to FIGS. 1 to 4, showing the injection pump in the suction period, there are provided a plurality of first radial passages 58, 60, 62, 64, 66, 68 communicated with first pressure chamber 44. The number of the radial passages 58, 60, 62, 64, 66, 68 corresponds to the number of the cylinders which is, in this case, 6. One of these radial passages 58~68 is in communication with a first stationary passage 70 formed in the sleeve 40. Similarly, one of a plurality of second radial passages 72, formed in communication with the second pressure chamber 50, is also in communication with a second stationary passage 74 formed in the sleeve 40. The number of the second radial passages 72 also corresponds to the number of the cylinders which is, in this case, 6. The ends of the first and the second stationary passages 70, 74 are adapted to be closed by armatures 76, 77 of first and second solenoid valves 78, 80, respectively.

The solenoid valves 78, 80, have a substantially identical structure which includes the armatures 76, 77 mounted in casings 82, 84 for movement in the up and down directions as viewed in the drawings. This vertical movement of each armature 76, 77 is effected by turning on and off the corresponding solenoid valve 78 and 80.

Each solenoid 78, 80 is provided with a coil 86 or 88, stationary magnetic pole 90 or 92 and a spring 94 or 96 disposed between the stationary magnetic pole and the armature. In the normal state in which the solenoid coils 86 and 88 are kept in off state, the armature 76, 77 is pressed by the springs 94 and 96 downwardly to keep the valve in the closing position.

In each solenoid valve 78, 80, as the coil 86, 88 is energized by the electric current supplied through the terminal 98, 100, a path of magnetism is formed which includes the stationary magnetic poles 90, 92, casings 82, 84 and the armatures 76, 77, so that the armatures 76, 77 are moved upwardly, overcoming the force of the spring 94, 96, thereby to open the valve. As a result of the opening of the valve 78, 80, the end of the first stationary passage 70 or the second stationary passage 74 is released. In this case, it is not always necessary to make the timings of openings of the solenoid valves 78, 80 coincide with each other. As these valves are opened, the fuel, pressurized to a predetermined pressure by a pump (not shown) driven by the engine or an electric motor, is charged into the first and the second pressure chambers 44, 50 through the opened first and second stationary passages 70, 74, via the first and second radial passages 58, 72 communicated with this stationary passages 70, 74.

The aforementioned spill port 56 is communicated with the low-pressure side of the pump through a spill passage 102 formed in the sleeve 40 and a discharge passage 104 formed in the sleeve holder 42. On the other hand, output passages 106, 108, 110, 112, 114, and 116, the number of which is, in this case, 6, are formed radially in the sleeve 40. The discharge passage 54 formed in the rotor 10 is made to communicate with one of these 6 radial output passages 106–116 and further with connection ports 118, 120, 122, 124, 126, 128 formed in the sleeve holder 42. Each connection port 118–128 is communicated with the fuel injection valve of each cylinder through a conduit (not shown).

The solenoid valves 78, 80 are communicated at their upstream sides with a fuel supply port 130, so that the fuel under regulated pressure is supplied to the first pressure chamber 44 and the second pressure chamber 50 via the first and second stationary passages 70 and 74, as respective solenoid valve 78, 80 are opened.

A pulser 132 attached to the right-side end of the rotor 10 is adapted to be rotated as a unit with the latter. A detector 134 for cooperating with the pulser 132 is attached to the outer periphery of the latter. The combination of the pulser 132 and the detector 134 may be a device which is of the same type as the rotation detector of a contact-less ignition device for a spark ignition type engine, such a combination being shown, for example, in U.S. Pat. 3,145,324. In this case, the combination of the pulser 132 and the detector 134 is used to produce an electric signal at a detection output terminal 136 when the rotor 10 is in the timing for commencement of the fuel supply to the pump rotor, i.e. in the period at which each solenoid valve 78, 80 starts to open to permit the supply of the fuel.

In the injection pump of this embodiment, the control of the amount of sucked fuel in the suction period $\theta_1$ shown in FIG. 2 is conducted in a manner explained hereinunder.

An electronic controller 160 operates, upon receipt of the signal representing the timing of commencement of the suction period coming from the detection terminal 136, to energize both of the first solenoid valve 78 and the second solenoid valve 80 simultaneously or with a certain time difference, i.e., without delay or at a predetermined time lag, thereby to open the valves 78, 80. In this regard, electronic controller 160 can utilize any known solenoid valve trigger circuits, e.g., each of valves 78, 80 may receive an energizing signal from a respective control circuit of the type shown in FIG. 9 of U.S. Pat. No. 2,980,090, a time lag being induceable by connecting one of the control circuits in series with a conventional time delay circuit (such as a monostable multivibrator), or a controller of the type shown in Japanese Laid-Open Application 51-83934(1976) may be used. As the first solenoid valve 78 is opened, the fuel under a suitable regulated pressure is supplied to the first pressure chamber 44 from the fuel supply port 130 through the first stationary passage 70 and the first radial passage 58. At this moment, the rollers 20, 22 and the roller shoes 18, 19 are not restricted by the cam contour (suction period $\theta_1$ in FIG. 2), so that two plungers 12, 14 are allowed to be displaced radially outwardly. Therefore, the fuel is charged into the first pressure chamber 44 at a rate which is determined by various factors including the opening period of the first solenoid valve 78, size of the passage and the pressure difference between the fuel pressure at the fuel supply port 130 and that in the first pressure chamber 44. Namely, the suction characteristic is determined taking into account the centrifugal force acting on the plungers 12, 14 or other factors, irrespective of whether the fuel pressure at the supply port 130 is kept constant independently of the rotation speed of the pump or is varied depending on the rotation speed. Practically, however, the amount of fuel supplied into the first pressure chamber 44 is determined solely by the opening period of the first solenoid valve 78.

Similarly, the amount of liquid (fuel) charged into the second pressure chamber 50 is determined by the timing of opening of the second solenoid valve 80. The liquid (fuel) which has been charged into the second pressure chamber 50 acts to displace the free piston 46 to the left as viewed in FIG. 5 to increase the pressure in the first pressure chamber 44 thereby to displace the plungers 12, 14 radially outwardly. As will be explained later, the spill port 56 is closed as the free piston 46 is moved to the left.

The free piston 46 is moved to the left in accordance with the amount of fuel supplied to the second pressure chamber 50. In addition, the plungers 12, 14 are displaced radially outwardly by an amount corresponding to the addition of the liquid to the first pressure chamber 44.

In the operation described heretofore, the pressurizing mechanism constituted by the plungers 12, 14, roller shoes 18, 19, rollers 20, 22 and the cam ring 24 operates to realize an initial period in which the suction of the fuel into respective chambers is allowed without any restriction.

The discharging operation of the injection pump in the compression period $\theta_2$ shown in FIG. 2 will be explained hereinunder.

In the compression period, as shown in FIG. 2, the roller 20, 22 is urged radially inwardly upon contact with the cam contour, so that the plungers 12, 14 are moved radially inwardly.

In this period, the communication between the first radial passage 58 and the first stationary passage 70, as well as the communication between the second radial passage 72 and the second stationary passage 74, is interrupted.

On the other hand, the discharge passage 54 leading from the second pressurizing chamber 50 is brought into communication with one of the output passages 106, the number of which corresponds to the number of cylinders of the engine. This output passage 106 is connected to the corresponding connection port 118 (See FIG. 4) which in turn is connected to the fuel injection valve of the corresponding cylinder of the engine through the pipe connected thereto. In this compression period, the spill port 56 formed adjacent to the first pressure chamber 44 is kept closed by the free piston 46.

As the rotor 10 rotates in this state of communication, the pressure of the liquid (fuel) in the first pressure chamber 44 is increased as a result of the radially inward movement of the plungers 12, 14 caused by the cam contour. When the pressure of the liquid in the first pressure chamber 44 is increased, the spill port 56 is still kept closed by the side surface of the free piston 46, so that the fuel in the second pressure chamber 50 is also pressurized through the action of the free piston 46. The fuel in the second pressure chamber 50 thus pressurized is then injected from the fuel injection valve of the corresponding cylinder, through the discharge passage 54, output passage 106 and the connection port 118.

As a result of the discharge of the fuel from the second pressure chamber 50, the free piston 46 is moved to the right to take the state as shown in FIG. 1. In this state, the spill port 56 is opened to that the pressurized fuel in the first pressure chamber 44 is discharged to the low-pressure side of the pump through the spill port 56, so that the pressure in the first pressurizing chamber 44 is lowered drastically. As the spill port 56 is released, the transmission of the pressure to the second pressure chamber 50 through the free piston 46 is ceased to complete the compression stroke.

As the rotor 10 is further rotated to commence the next suction period, the free piston 46 is moved to the left by an amount corresponding to the amount of supply of the fuel to the second pressure chamber 50. This amount of the liquid (fuel) charged into the second pressure chamber 50 corresponds to the amount of fuel discharged through the discharge passage in the subsequent compression period until the spill port 56 is opened. Thus, the amount of fuel charged into the second pressure chamber 50, controlled by the opening period of the solenoid valve 80, is the amount of the injection (discharge) in the compression period.

On the other hand, the amount of fuel sucked into the first pressure chamber 44 in accordance with the control of opening period of the solenoid valve 78 is related to the determination of the injection timing, i.e. the timing at which the compression is started. Namely, the amount of the liquid supplied to the first pressure chamber 44 determines the radial position of the plungers 12, 14 and, hence, the radial position of the roller 20, 22. In consequence, the timing at which the roller 20, 22 is contacted by the cam contour, i.e. the timing at which the compression period $\theta_2$ is commenced, is determined by the amount of liquid supplied into the first pressure chamber 44.

This operation will be explained in more detail with specific reference to FIG. 2.

Referring to FIG. 2, the cam ring 24 is kept stationary and is provided on its peripheral surface with a cam contour portion for determining the suction period $\theta_1$ and the cam contour portion for determining the compression period, $\theta_2$ which are formed alternatingly. The cam contour portion for the suction period $\theta_1$ has such a configuration as not to restrict the radially outward movement of the plungers 12, 14, roller shoes 18, 19 and the rollers 20, 22, whereas the cam contour portion for the compression period $\theta_2$ is so shaped as to displace the rollers 20, 22 and, hence, the roller shoes 18, 19 radially inwardly as the rotor 10 rotates, thereby to cause a radially inward displacement of the liquid in the first pressure chamber 44.

When the opening period of the first solenoid valve 78 is long to permit a large amount of fuel to be supplied to the first pressurizing chamber 44, the radial displacement of the plungers 12, 14, roller shoes 18, 19 and the rollers 20, 22 is increased correspondingly so that the roller 20, 22 comes into contact with the inner surface of the cam ring 24 at an earlier period to permit an earlier commencement of the compression period $Q_2$, resulting in earlier compression and discharge of the fuel.

When the opening period of the second solenoid valve 80 is long to permit a large amount of fuel to be charged into the second pressure chamber 50, the position of the free piston 46 is offset to the left so that the plungers 12, 14 are also offset radially outwardly for a given amount of the fuel supplied to the first pressure chamber 44. In consequence, the compression period is commenced at an earlier timing, for the same reason as stated before. In this case, the time length of the compression and discharge period $\theta_2$ itself does not change substantially even when the amount of fuel charged into the first pressure chamber 44 is changed.

Namely, while the amount of injected fuel is the amount of fuel supplied to the second pressure chamber so, the timing of completion of the injection (compression and discharge) is determined by the minimum radius portion of the inner peripheral surface of the cam ring 24, provided that the amount of supply to the first pressurizing chamber 44 is zero. In other words, the timing of commencement of the injection is made earlier as the amount of fuel injection, i.e. the amount of fuel supplied to the second pressure chamber 50, is increased, while the timing at which the injection is finished is unchanged. By supplying the fuel to the first pressurizing chamber 44, the timing of commencement of the injection can be made earlier by an amount or time length corresponding to the amount of fuel supply to the first pressure chamber 44. In this case, however, there is a possibility that the fuel sucked into the first pressure chamber 44 is excessively pressurized in the compression period or compressed over an excessively long stroke. The aforementioned fuel spill port 56 is provided to suitably regulate the timing of completion of the injection, overcoming the above stated problem.

Thus, the fuel of an amount corresponding to that sucked into the second pressurizing chamber 50 is injected in the injection period which starts at a timing determined by the amounts of fuel sucked into the first and the second pressure chambers 44, 50. When, the free piston 46 reaches the spill port 56, it is opened so as to release all or part of the fuel in the first pressure chamber 44 into the discharge passage 104 through the spill port 56, so that the pump resumes the starting condition. This operation is repeated successively in accordance with the cam contour of the cam ring 24.

As will be understood from the foregoing description, in the embodiment heretofore described, the amount and timing of the fuel injection are controlled by the opening periods of two solenoid valves 78, 80. Thus, it is possible to obtain a fuel injection pump having a simple construction at a low cost of production, by eliminating the necessity for the feedback control. In addition, complicated angle advance mechanism incorporating a rotatable cam ring, which is used in the conventional fuel injection pump, is eliminated to simplify the structure. In addition, since the injection amount and the injection timing are controlled at each time of the injection, it is possible to effect a precise control even when the operation speed is high.

Figure 5:
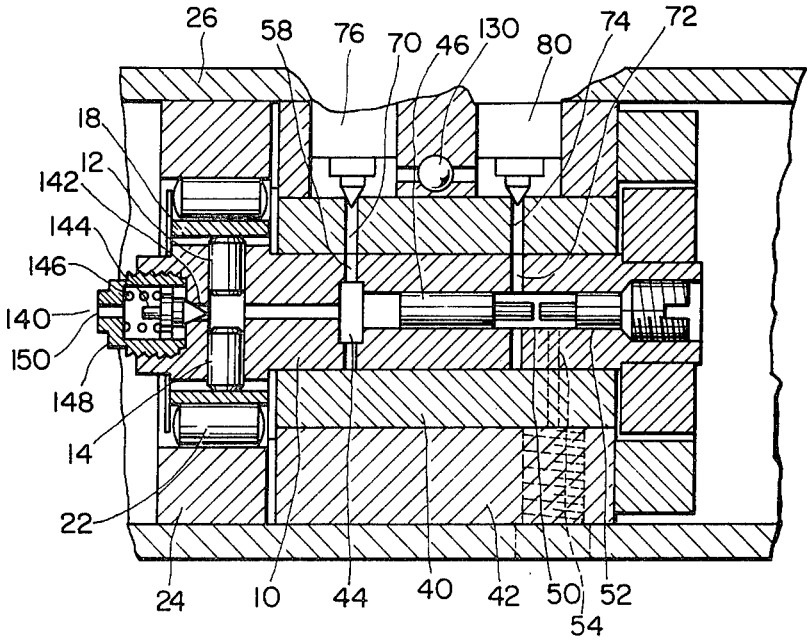
FIG. 5 is a vertical sectional view of an injection pump in accordance with another embodiment of the invention.

FIG. 5 shows another embodiment of the injection pump of the invention, in which a high-pressure relief valve 140 is used in place of the spill port 56 of the first embodiment. Other portions are materially identical to those of the first embodiment described in connection with FIGS. 1 to 4.

Referring to FIG. 5, a high-pressure relief port 142 is formed to communicate with the first pressure chamber 44. The high-pressure relief port 142 is normally closed by a valve member 144 of a high-pressure relief valve 140 which includes, in addition to the valve member 144, a spring 146 and a retainer 148. A bore 150 for releasing the pressurized fuel is formed in the retainer 148.

In the operation of the injection pump of this embodiment, as the liquid in the second pressure chamber 50 is discharged to the discharge passage 54 in the course of the compression period, the free piston 46 comes into contact with the stopper 52 to further raise the pressure in the first pressure chamber 44. As this elevated pressure exceeds the normal injection pressure, the force of the spring 146 is overcome to permit the valve member 144 to be moved to the left so that the liquid of the high pressure is relieved to the low-pressure side through the peripheral notch in the valve member 144 and the bore 150. Thus, as in the case of the spill port 56 in the first embodiment, the high-pressure relief valve of the second embodiment functions to determine the timing of completion of the injection, i.e. the timing of finish of the compression period. Operations of other parts are materially identical to those of the first embodiment.

As will be understood from the foregoing description, the second embodiment shown in FIG. 5 permits the control of the injection rate and injection timing in the same manner as the first embodiment in connection with FIGS. 1 to 4.

From the foregoing description, it will be seen that, according to the invention, there is provided a highly reliable injection pump which permits an adequate control of the rate and timing of the injection.

I claim:

1. An injection pump suited for the delivery of liquid fuel under high pressure to the cylinders of an associated engine comprising:

a housing;

a sleeve mounted on said housing and having first and second stationary passages, each passage communicating with a liquid fuel supply;

a rotor having a central axial bore and a radial bore formed therein, said rotor being inserted in said sleeve and rotated in timed relationship with the engine;

a free piston reciprocally disposed in the central axial bore between first and second pressure chambers, the first chamber including a plurality of first radial passages and a radial spill port and being communicated with the radial bore of said rotor, the second pressure chamber including a plurality of second radial passages and a discharge passage;

a first solenoid value for controlling the amount of liquid fuel sucked into the first pressure chamber through the first stationary passage;

a second solenoid valve for controlling the amount of the liquid fuel sucked into the second pressure chamber through the secondary stationary passage;

a pair of opposing plungers reciprocably disposed in the radial bore of said rotor, and being so constructed as to produce, in accordance with the revolution of said rotor, a compression period in which the liquid fuel is pressurized in the first pressure chamber to move the free piston to pressurize the fuel in the second pressure chamber to supply fuel in the second chamber to the engine through the discharge passage, and a suction period in which the liquid fuel is supplied to the pressure chambers;

a pulser attached to said rotor and adapted to be rotated as a unit with said rotor;

a detector arranged in relation to an outer periphery of said pulser for producing an electric signal in cooperation with said pulser when said rotor is in the timing for commencement of the fuel supply;

an electronic controller for determining an opening period of said first and second valve during a certain time of said suction period after receipt of said signal, whereby the timing of discharge of liquid fuel and the volume of discharge of the liquid fuel are controlled.

2. An injection pump as claimed in claim 1, wherein the spill port is opened when said free piston has come to take a predetermined position, the spill port being adapted to permit the liquid in the first pressure chamber to be spilt to the low pressure section thereby to finish said compression period.

3. An injection pump as claimed in claim 1, wherein the first pressure chamber is provided with a high-pressure relief valve adapted to be opened when the pressure in the pressure chamber has reached a predetermined value.

4. An injection pump as claimed in claim 1, wherein said controller opens said valves with a predetermined time difference.

* * * * *